US006708465B1

(12) United States Patent
Gustafsson

(10) Patent No.: US 6,708,465 B1
(45) Date of Patent: Mar. 23, 2004

(54) DEVICE AND METHOD FOR WRAPPING SOFT ELEMENTS

(76) Inventor: Glenn Gustafsson, Munkegårdesgatan 99, SE-442 41 Kungälv (SE)

( * ) Notice: Subject to any disclaimer, the term of this patent is extended or adjusted under 35 U.S.C. 154(b) by 0 days.

(21) Appl. No.: 09/913,724

(22) PCT Filed: Feb. 22, 2000

(86) PCT No.: PCT/SE00/00348

§ 371 (c)(1),
(2), (4) Date: Nov. 16, 2001

(87) PCT Pub. No.: WO00/50306

PCT Pub. Date: Aug. 31, 2000

(30) Foreign Application Priority Data

Feb. 22, 1999 (SE) ..... 9900599

(51) Int. Cl.[7] ..... B65B 51/10

(52) U.S. Cl. ..... 53/463; 53/436; 53/438; 53/439; 53/477; 53/511; 53/526; 53/529; 53/370.8; 53/370.9; 53/373.8

(58) Field of Search ..... 53/434, 436, 438, 53/439, 463, 477, 479, 511, 523, 526, 529, 370.8, 370.9, 373.8, 373.9; 156/497, 498

(56) References Cited

U.S. PATENT DOCUMENTS

| | | | | | |
|---|---|---|---|---|---|
| 3,458,966 | A | * | 8/1969 | Dunbar et al. | 53/434 |
| 3,499,261 | A | * | 3/1970 | Hullhorst et al. | 53/438 |
| 3,710,536 | A | | 1/1973 | Lee et al. | |
| 3,751,876 | A | | 8/1973 | Oakley et al. | |
| 3,837,138 | A | * | 9/1974 | Terry | 53/439 |
| 4,103,473 | A | * | 8/1978 | Bast et al. | 156/497 |
| 4,218,863 | A | * | 8/1980 | Howard et al. | 53/370.9 |
| 4,501,107 | A | | 2/1985 | Piotrowski | |
| 4,679,379 | A | * | 7/1987 | Cassoli | 53/438 |
| 4,751,807 | A | * | 6/1988 | Couturier | 53/439 |
| 4,858,416 | A | * | 8/1989 | Monaghan | 53/439 |
| 5,058,361 | A | * | 10/1991 | Schmacher | 53/370.9 |
| 5,177,935 | A | * | 1/1993 | Jones et al. | 53/439 |
| 5,400,569 | A | * | 3/1995 | Jones et al. | 53/439 |
| 5,979,145 | A | * | 11/1999 | Louis et al. | 53/439 |
| 6,098,378 | A | * | 8/2000 | Wyatt | 53/449 |

FOREIGN PATENT DOCUMENTS

| | | |
|---|---|---|
| DE | 344 4897 A1 | 6/1986 |
| DE | 195 08 155 A1 | 9/1995 |
| DE | 198 33 795 A1 | 8/1999 |
| EP | 0 248 576 A1 | 12/1987 |
| FR | 1528377 | 4/1968 |
| GB | 1238373 | 7/1971 |
| SE | 465 082 | 7/1991 |
| WO | WO 98/40202 A1 | 9/1998 |

* cited by examiner

*Primary Examiner*—Stephen F. Gerrity
*Assistant Examiner*—Louis Huynh
(74) *Attorney, Agent, or Firm*—Burns, Doane, Swecker & Mathis, L.L.P.

(57) ABSTRACT

The invention relates to a method for wrapping a plurality of soft elements, comprising the steps of stacking the elements, compressing the stack in a direction of stacking, and thus forming a package, inserting in a feeding direction the package into a film, preferably a plastic film, which at least partly consists of a thermoplastic material and which in an at least partly overlapping manner surrounds the package, sealing the film in the feeding direction, and cutting and optionally sealing the film transversely of the feeding direction. The method is characterised in that the step of sealing the film in the feeding direction is carried out by supplying from a nozzle towards the film a pressurised heated gas towards the portions of the film that overlap each other, so that they change into an at least partly molten state and are joined. The invention also relates to a device for carrying out the method.

24 Claims, 4 Drawing Sheets

DEVICE AND METHOD FOR WRAPPING SOFT ELEMENTS

FIELD OF THE INVENTION

The present invention relates generally to a method and a device for wrapping a plurality of soft elements, and specifically for wrapping boards of fibrous insulating material.

BACKGROUND ART

As a rule, equipment for wrapping insulating material is connected directly to a production line where the material is sawn and/or cut in specified sizes. This is a continuous process where the boards are usually supplied at a rate of one board per second or faster.

When wrapping pads or boards of a soft material, such as insulating material, a method has since long been applied, in which rectangular boards are stacked into a stack, compressed in the direction of stacking into a package, and then provided with a coating of a thin flexible material, such as plastic, which maintains the package in its compressed state.

According to a frequently used method, the packages are inserted in their longitudinal direction into an opening of a sack or tube of plastic, which is then possibly welded together at its open end.

To automate the handling and eliminate the need for a sack or tube, an alternative method is used, in which each package, while being continuously fed, is coated with a surrounding, but not sealed plastic material, which is first welded along the long sides of the package. Subsequently welding and cutting between the packages are carried out. By welding is here meant all kinds of joining where at least part of the wrapping material is heated during joining.

The welding along the long sides of the package is difficult to accomplish in a satisfactory manner, and complicated devices are necessary to weld the packages in a quick and reliable manner. In particular, it is difficult to apply in a satisfactory manner the necessary pressure to the joint without it being weakened, especially if the surrounding material is a plastic material.

In certain embodiments of the above method, the sides of the packages are, perpendicular to the direction of compression, subjected to a mechanical pressure, which results in an unfavourable pressure gradient. There is a risk that the fibres of the material, if any, will be damaged if excessive mechanical pressure is applied to the package. This is a major problem since most insulating materials consist of fibre materials which are sensitive to pressure being applied transversely of the fibres.

Furthermore, the compressed package, while being fed, frequently passes irregularities in the conveying paths, such as bumps or gaps. These irregularities are propagated through a plurality of boards in the compressed package and result in additional pressure gradients and damage the fibres.

SUMMARY OF THE INVENTION

A first object of the present invention is to provide automatic wrapping, which in every respect is satisfactory, of an insulating material, without the material being subjected to detrimental pressure gradients.

A second object of the present invention is to provide a simple and strong seal of packages of compressed insulating material.

These objects are achieved by a method which comprises the steps of stacking the elements, compressing the stack in a direction of stacking, thereby forming a package, inserting the package in a feeding direction into a film, preferably a plastic film, which at least partly consists of a thermoplastic material and at least in a partly overlapping manner surrounds the package, sealing the film in the feeding direction, and cutting and optionally sealing the film transversely of the feeding direction. The method is characterised in that the sealing of the film in the feeding direction is carried out by applying heat to the portions of the film which overlap each other so that they change into an at least partly molten state, and by supplying, from a nozzle means in the direction of the film, a pressurised fluid so that the portions are joined.

The expression film relates to a thin and flexible material, which is capable of tightly surrounding the compressed material.

The method can be accomplished by means of a device according to independent claim 8.

By the compression of the overlapping portions occurring by means of pressurised fluid, mechanical action is avoided and the risk of weakening the joint is eliminated. In a preferred embodiment of the invention, a nozzle supplies a heated, pressurised gas, preferably air, in the direction of the overlapping portions of the film. In this manner, the gas flow causes both heating and compression of the film.

To prevent overheating of the joint, which may result in reduced strength and holes in the film, the heating is interrupted preferably in connection with an interruption of the feeding of the package. If the heating occurs by means of heated gas, the interruption may take place by the gas flow being diverted through an outlet of the nozzle means. The diverted flow of air then produces a negative pressure outside the nozzle means, so that the flow through the nozzle means is reversed. Thus, surrounding, cooler air is made to flow past the heated joint and cool it.

Downstream of the compression of the heated portions, these can be cooled, for example by supplying cold air.

According to a preferred embodiment of the invention, a negative pressure is produced between the film and the package. This negative pressure contributes to holding the film in place during sealing. Downstream of the sealing, the negative pressure in the partly wrapped package makes the film fit close to the package and counteract expansion of the insulating material in the wrapping process. This implies that the package can be transported past irregularities in the conveying paths without the fibres being damaged.

According to an embodiment, the negative pressure is produced with the aid of a suction means on each side of the feeding path, said suction means preferably being a double-walled metal sheet which extends along a distance of the package in the feeding direction, said sheet being formed with recesses towards the package and connected to a source of negative pressure. Such a sheet can be fixedly arranged at its upstream end and, downstream together with the package, be wrapped by the film. At the downstream end of the metal sheets, where the sealing of the film has at least begun, a connection between the metal sheet and the surroundings would therefore be impossible, which means that the metal sheet will be slightly yielding in the lateral direction. A package which is fed past the suction means may thus be allowed to vary in width to some extent without causing too much resistance.

It is preferable, downstream of the sealing along the feeding direction according to a technique which is known per se, to carry out sealing and cutting transversely of the feeding direction. When a package is sealed at its downstream end, it is thus wrapped by film on all sides except one, and therefore the negative pressure from the suction means gives a still greater joining effect.

Each sealing operation transversely of the feeding direction occurs in this way between two packages which are located in a kind of tube, in which a relatively high negative pressure prevails. This results in a further advantage as the fed packages in level with the transverse sealing along a distance have no contact with the feeding assembly. Since the packages are firmly compressed, the absence of contact between continuous surfaces in this joint normally results in the material in the packages being allowed to expand, with the ensuing great pressure gradients. However, according to the described embodiment of the invention, the negative pressure in the tube which is fed over the joint contributes to resisting the expansion pressure, so that the material is not allowed to expand significantly. Pressure gradients which are detrimental to the material will thus be avoided.

BRIEF DESCRIPTION OF THE DRAWINGS

The present invention will now be described in more detail with reference to the accompanying drawings, which for the purpose of exemplification illustrate preferred embodiments of the invention.

DESCRIPTION OF A PREFERRED EMBODIMENT

1. General Description

Figure 1:
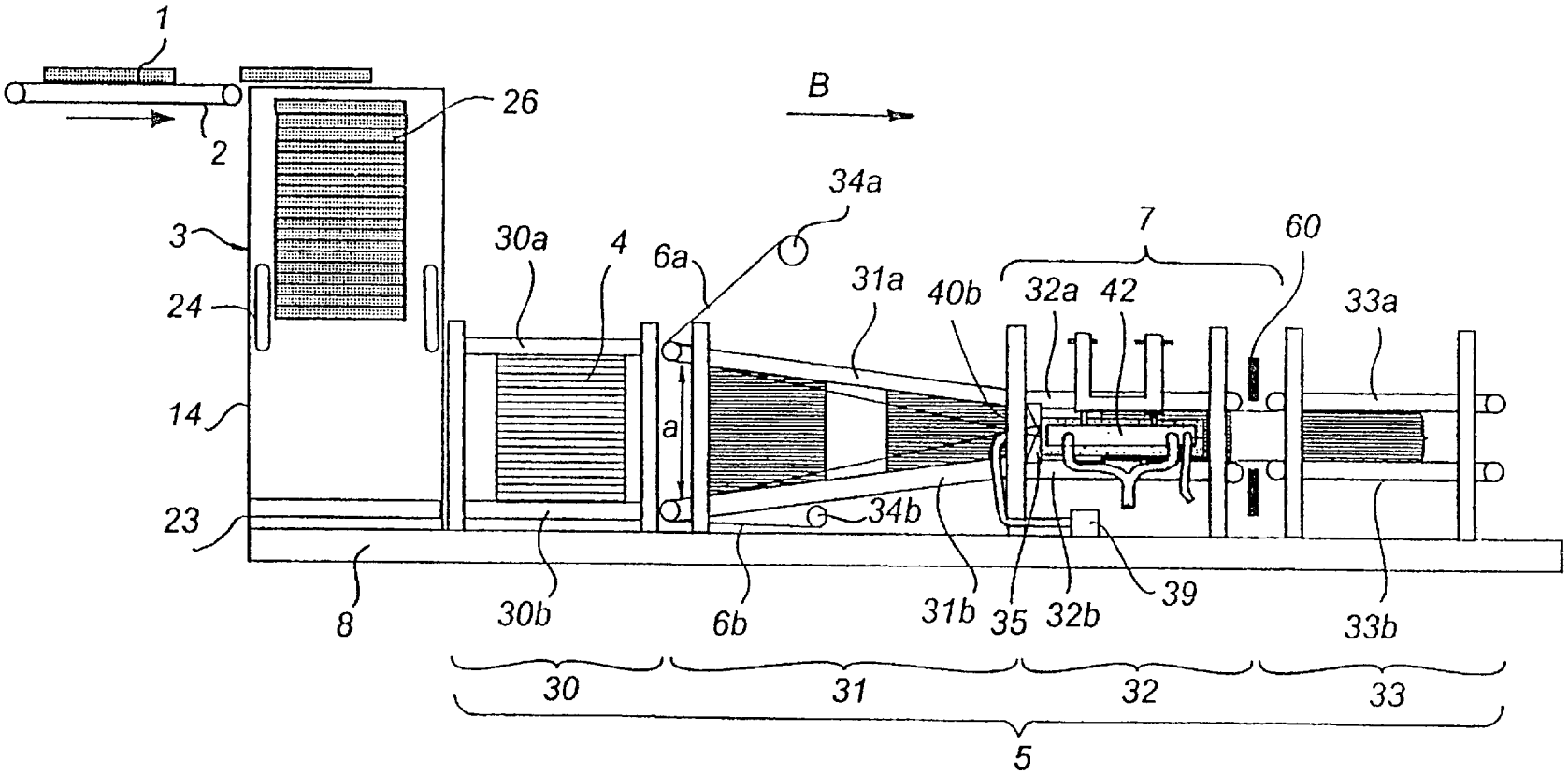
FIG. 1 is a schematic side view of a device according to the invention adapted to carry out the method according to the invention.
Figure 2:
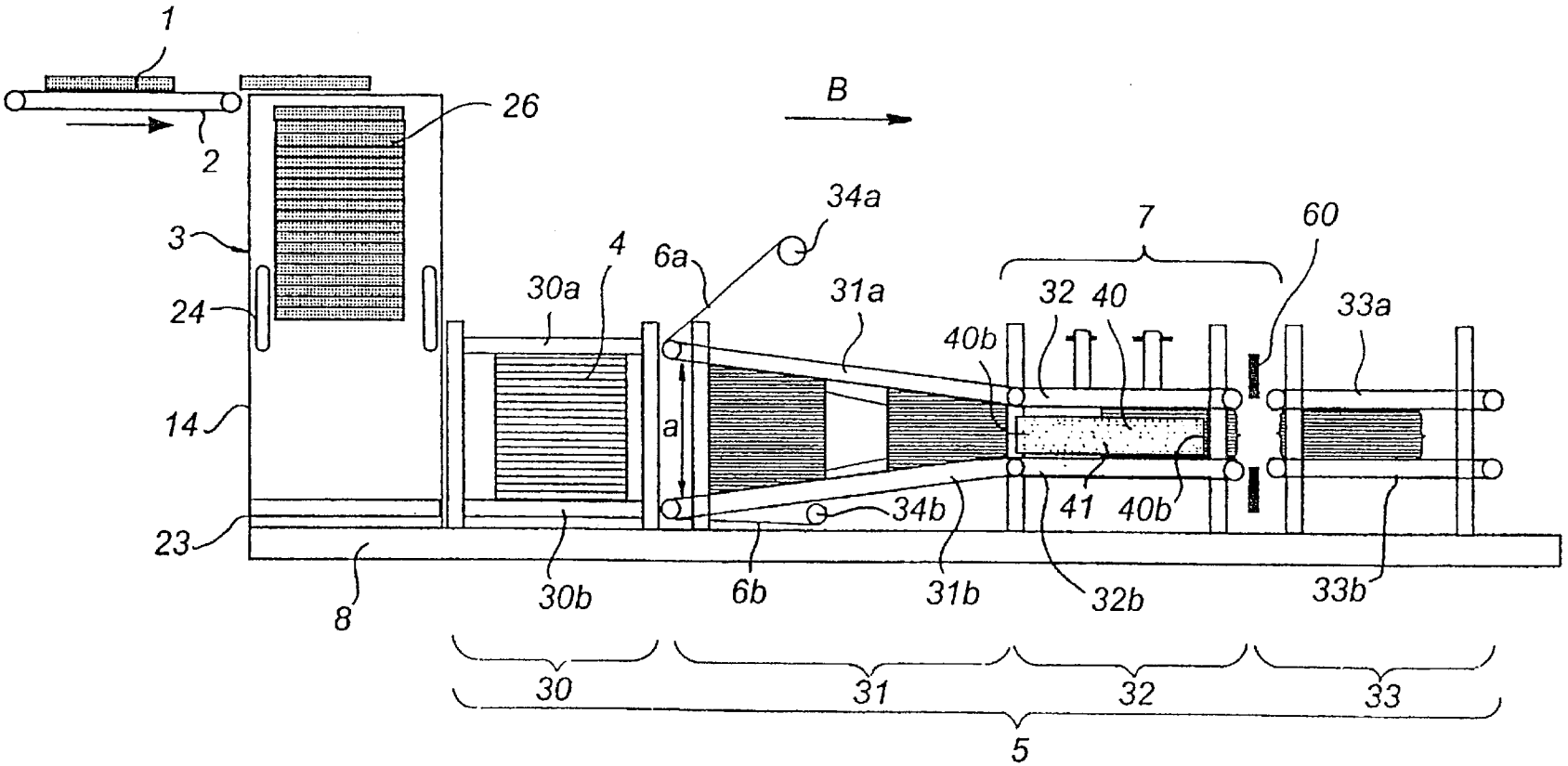
FIG. 2 is a schematic cross-sectional view of the device in FIG. 1.

Wrapping of material takes place according to an embodiment of the invention along a process chain according to FIGS. 1–2. The material, which in the example shown consists of boards 1 of a fibrous insulating material, is fed on a conveyor belt 2 to a compressing assembly 3 where the boards are stacked and compressed. The compressed package 4 is then introduced by a feeding assembly 5 into a thin and flexible wrapping material 6 and further to a sealing arrangement 7 according to the invention, where the packages are sealed, first along the feeding direction and then transversely of the feeding direction. The entire device is held together by a stand 8, preferably consisting of a plurality of welded-together beams.

2. Compressing Assembly

The compressing assembly 3 may comprise a compressing shaft 14 where a stack 26 of boards 1 forms so as to be compressed. The compressed stack is then removed from the shaft, for example by driven belt conveyors 23, 24 being arranged at the upper and lower side of the stack.

3. Feeding Assembly

In direct connection with the compressing assembly 3, a feeding assembly 5 is arranged to transport the package in a feeding direction B, past the sealing arrangement which will be described below. The feeding assembly 5 comprises a plurality of feeding segments, each segment having at least an upper and a lower conveyor. In the preferred embodiment, the feeding assembly has four segments 30, 31, 32, 33 and all conveyors consist of belt conveyors 30*a*, 30*b*, 31*a*, 31*b*, 32*a*, 32*b*, 33*a*, 33*b*.

The first feeding segment 30 is arranged in direct connection with the compressing shaft 14 and adapted to receive a compressed package 4 which is discharged from the shaft by the conveyor belts 23, 24 a–c. The belt conveyors 30*a*, 30*b* in this segment are parallel with each other and do not affect the compression of the package.

The subsequent feeding segment 31 has belt conveyors 31*a*, 31*b* converging in the feeding direction, the distance a between them being at its maximum in connection with the preceding segment, and then decreasing successively. This segment therefore compresses one more package 4, which is conveyed between the belt conveyors.

The third feeding segment 32 is arranged to convey a package 4 while being compressed, past the sealing arrangement 7. In the embodiment shown in FIGS. 1–2, the segments 31 and 32 consist of joint belt conveyors, but it is also possible to make a division into separate belt conveyors.

The fourth feeding segment 33 is positioned downstream of the sealing arrangement 7 and is arranged to feed the wrapped packages 4 to further handling.

The feeding assembly 5 is further adapted to supply, during feeding, a wrapping material 6 which is to surround each package. The wrapping material is preferably thin and flexible and consists at least partly of a thermoplastic material which after heating is joinable. For example, the wrapping material consists of a possibly transparent plastic film, for example of polyethylene plastic, which is supplied from one or more rolls 34*a*, 34*b*.

The plastic film 6 runs from each roll 34*a*, 34*b* round the edge of one of the belt conveyors 31*a*, 31*b* and then between the belt conveyor and the package that is being fed. The plastic film 6 is thus entrained along with the package during feeding.

In the illustrated case, the plastic film is fed from two rolls 34*a*, 34*b*, a first film 6*a* covering the upper side of the package and a second film 6*b* covering its underside. The two films 6*a*, 6*b* overlap each other along the sides of the package. FIG. 1 shows how the film runs at the beginning of the converging feeding segment 31, but in an alternative embodiment (not shown) the film runs between the second 31 and the third 32 segment, i.e. at the beginning of the sealing arrangement 7.

At the upstream end of the sealing arrangement 7, turning-down elements 35 are arranged on each side of the feeding path, which are adapted to turn down the plastic film round the sides of each package.

Since a continuous film 6 surrounds a plurality of successive packages, it is important for the packages to be fed with a space in between, which allows the below described sealing of the ends. Transducers (not shown) are used to control the feeding, so that, when a package has been completely fed in between the converging conveyors, the feeding is discontinued while waiting for the next package. When this arrives from the compressing shaft 14 through the first feeding segment 30, the feeding starts again.

In combination with the interruption in feeding which arises in connection with the sealing of the ends of packages and which will be described below, two interruptions in the feeding of each package thus arise. For a certain length of the packages, these interruptions may, of course, coincide, in which case there will be only one interruption for each package.

4. Sealing Arrangement

Figure 3:
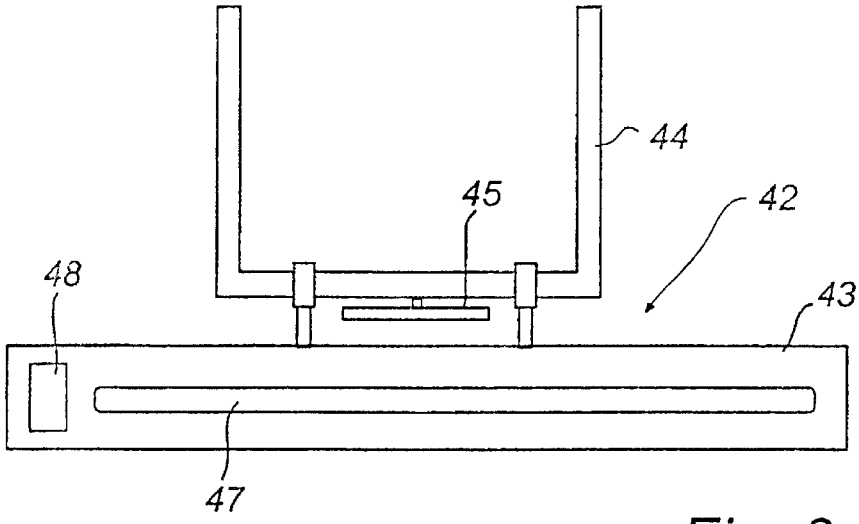
FIG. 3 is a schematic front view of a nozzle means according to the invention.
Figure 4:
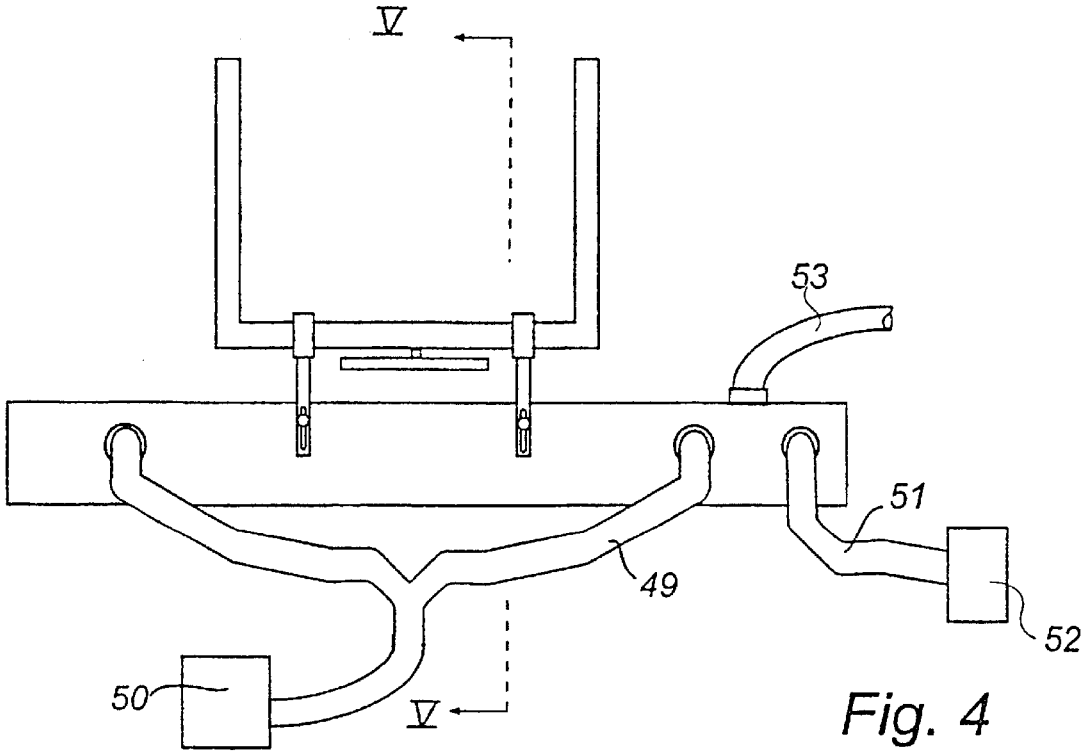
FIG. 4 is a schematic rear view of the nozzle means in FIG. 3.
Figure 5:
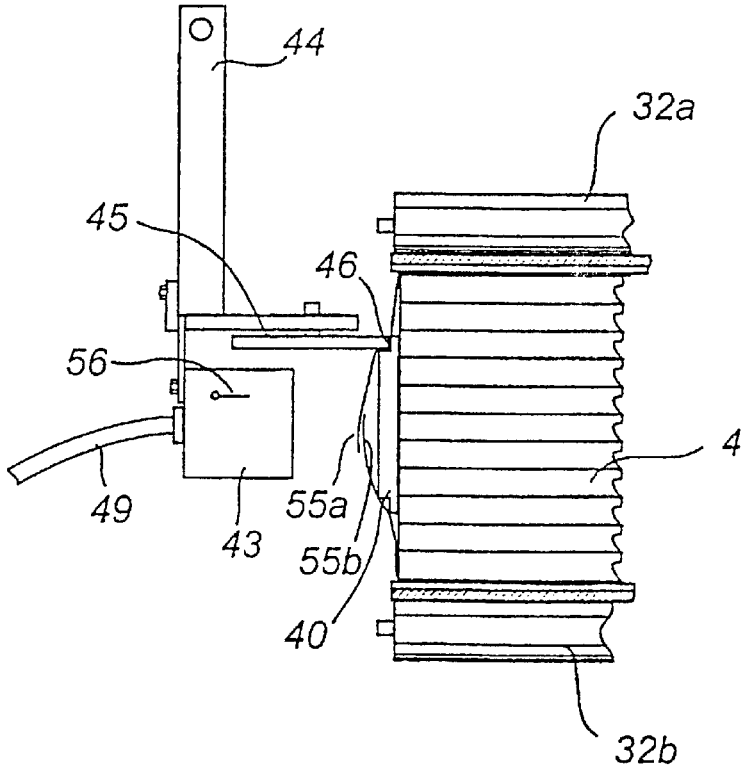
FIG. 5 is a longitudinal section of the nozzle means in FIGS. 3–4 along lines V—V, and a package passing the nozzle means.

A sealing arrangement 7 according to the invention is illustrated in FIGS. 3–5 and comprises means for sealing each package along the sides and means for sealing each package at the ends. The sealing operations are carried out in different ways.

The sealing along the sides is carried out by the thermoplastic material being heated to at least a partly molten state, and then by means of a fluid being compressed under pressure. In connection with the compression, the heated material is cooled, thereby forming a durable joint.

According to the preferred embodiment, a suction means is arranged on each side of the conveying path along the segment 32. The suction means may consist of a double-walled metal sheet 40 which is connected to a source of negative pressure 39 and which wholly or partly is coated with Teflon or like material. The inside of the metal sheet 40 is perforated by a plurality of apertures 41, and its downstream end wall 40*a* is open for transferring the negative pressure. The metal sheet 40 is at its upstream end 40*b*, just before the position where the plastic film is turned round the fed packages 4, suspended, for example, from the stand 8 that supports the feeding assembly. There is otherwise no fixed anchoring. The suspension can be completely fixed but can alternatively be articulated in one direction.

Outside each metal sheet 40 a nozzle means 42 is arranged, preferably yieldingly loaded against the metal sheet 40. In the shown example, each nozzle means 42 consists of an elongate metal case 43 which is suspended from a pendulum construction 44. The pendulum construction is provided with a control means in the form of a rotatable supporting wheel 45 which in operation abuts against the metal sheet 40 and thus holds the case 43 correctly spaced from the film 6. To this end, the metal sheet 40 can be formed with a groove 46 for improved guiding of the supporting wheel 45 (see FIG. 5).

In the side facing away from the conveying path, the case 43 has at least one connection 49 for a feeding means 50 for pressurised, heated fluid, preferably heated compressed air, and at least one connection 51 for a feeding means 52 for a cold fluid, preferably air. Moreover, the case 43 has an outlet 53.

In its side facing the conveying path, the case 43 also has a plurality of openings 47, 48 for feeding the fluid in the direction of the metal sheet 40 and the film 6. Preferably, the recesses consist on the one hand of an elongate slot 47 and, on the other hand, a slotted opening 48 positioned in the downstream end.

When a package 4 is fed in between the belt conveyors in the feeding segment 32, they are simultaneously guided in between the metal sheets 40. The plastic film 6 which has up to now been extended in an essentially planar state immediately above and below the package 4, is now by the turning-down elements 35 turned down round the package and the metal sheets in the manner which is best shown in FIG. 5. The negative pressure to which the metal sheet 40 is connected contributes to minimising any space between the package 4 and the metal sheet 40, and to the plastic film 4 being kept in place against the metal sheet. Since the metal sheets are only suspended at their upstream ends, they can move downstream in the lateral direction and thus be adapted to variations in the width of the packages.

Subsequently the package 4 passes the slot 47 which is formed in each case and which supplies heated compressed air 54 from the feeding means 50. The compressed air 54 puts the thermoplastic material in an at least partly molten state, and at the same time presses the overlapping portions 55*a*, 55*b* against each other so as to accomplish a joining. By partly molten state is meant that the portions 55*a*, 55*b* are joined by adhesion to each other or by being completely combined. The Teflon coating of the metal sheets 40 prevents molten plastic from adhering to the metal sheets.

Cold air is supplied through the opening 48 from the feeding means 52, thus cooling and curing the portions 55*a*, 55*b*.

According to a preferred embodiment, the double-walled metal sheets 40 extend along essentially the entire length of the nozzle means 42 and consequently constitute a firm abutment during the entire sealing process.

The nozzle means 42 is arranged to interrupt the feeding of heated gas 54 in each interruption in the feeding of packages. According to the embodiment illustrated, the feeding is interrupted by the flow of air being diverted to the outlet 53 by means of a diverting element, such as a throttle 56, arranged in each case. The flow of air is preferably diverted in such manner that the flow through the gap 47 is reversed and thus air is conveyed away from the welded joint, and surrounding cooler air is made to replace the removed hot air.

The sealing at the ends 4a of the package, transversely of the feeding direction, occurs in a manner known per se by means of two welding jaws 60 (see FIG. 2) which are movable towards each other and, arranged therebetween, a cutting means, for instance in the form of a cutting thread (not shown). The jaws 60 and the cutting means are positioned between feeding segments 32 and 33. In the example shown, the jaws are arranged above and below the feeding path, but they could, of course, just as well be positioned on both sides of the path.

The feeding is discontinued when a transducer (not shown) signals that the last hot-sealed package has reached the downstream end of the segment 32, and the anteriorly positioned package, which is located in the segment 33, is then moved back a distance to achieve a play in the wrapping material 6 between the packages 4.

Then the welding jaws 60 are moved towards each other, and the ends 4a of the packages are sealed and separated from each other (see FIG. 2). The package 4 which is located in the segment 33 is now completely wrapped and is fed for continued handling, for example joint wrapping, stacking and loading on pallets.

However, the package 4 which is still located in the segment 32 is only surrounded by plastic film on five of its six sides and thus is located in a plastic tube. The tube is fed past the welding jaws 60 to the next welding position, in which the tube contains two packages, one on each side of the welding jaws (see FIG. 1). In the tube a negative pressure prevails, which is produced by the suction means, and prevents the material in the packages from expanding in level with the welding jaws.

5. Conclusion

It will be appreciated that the invention as defined in the appended claims is not restricted by the above description of preferred embodiments. For instance, the feeding assembly can be allowed to be of different design and extent. Moreover, additional steps can be added to the process for adaptation to different needs.

The described devices may vary in respect of form as well as material, and the person skilled in the art is expected to make the adaptations as required by a particular situation.

The film 6 can be made of an arbitrary, flexible material, such as textile, paper or metal foil. It may be sufficient for the overlapping portions 55*a*, 55*b* to be coated with a thermoplastic material, such as plastic or adhesive.

What is claimed is:

1. A method for wrapping a compressed stack of soft elements, comprising the steps of:

inserting the compressed stack in a feeding direction into a sleeve having overlapping portions so that the sleeve surrounds the compressed stack, and sealing the overlapping portions of the sleeve in the feeding direction by:

providing a flow of air from between the sleeve and the compressed stack, thereby creating a negative pressure, providing an essentially flat surface between the sleeve and the compressed stack along the overlapping portions, the surface being cooled by the flow of air, applying heat to the overlapping portions of the sleeve so that the overlapping portions change into an at least partly molten state, and applying a pressurized fluid towards the partly molten overlapping portions, so that the portions are pressed against the cooled surface and joined together wherein the sleeve at least partly includes a thermoplastic material.

2. A method as claimed in claim 1, wherein the heat application is interrupted in case of interruption of the feeding of the compressed stack.

3. A method as claimed in claim 2, further comprising the step of cooling the overlapping portions downstream of the heat application.

4. A method as claimed in claim 2, further comprising the step of cutting and sealing the sleeve transversely of the feeding direction.

5. A method as claimed in claim 1, wherein the step of applying heat and pressurized fluid are carried out by applying a heated, pressurized fluid.

6. A method as claimed in claim 5, wherein the fluid is diverted in case of interruption of the feeding of the package.

7. A method as claimed in claim 1, further comprising the step of cooling the overlapping portions downstream of the heat application.

8. A method as claimed in claim 1, further comprising the step of cutting and sealing the sleeve transversely of the feeding direction.

9. A method according to claim 8, wherein the negative pressure is created upstream of the step of cutting the sleeve transversely of the feeding direction.

10. A device for wrapping a compressed stack of soft elements, comprising:

feeding means for inserting in a feeding direction the compressed stack into a sleeve having overlapping portions including, so that the sleeve surrounds the compressed stack, and sealing arrangement for sealing the overlapping portions of the sleeve including:

suction means arranged between the sleeve and the compressed stack, for producing a negative pressure between the compressed stack and the sleeve, the suction means having an essentially flat surface facing the film, the surface being cooled by a flow of air through the suction means, means for heating the overlapping portions of the sleeve, and nozzle means for applying a pressurized fluid towards the overlapping portions, the heating means and the nozzle means being arranged in alignment with the suction means, so that the cooled surface provides a support against which the overlapping portions can be pressed by the pressurized fluid wherein the sleeve at last partly includes a thermoplastic material.

11. A device as claimed in claim 10, wherein the nozzle means is arranged to apply heated fluid towards the overlapping portions of the sleeve.

12. A device as claimed in claim 11, wherein the nozzle means comprises means for diverting the fluid flow in case of interruption of the feeding of the compressed stack.

13. A device as claimed in claim 12, wherein the nozzle means is arranged to selectively reverse the direction of flow of the fluid.

14. A device as claimed in claim 11, wherein the nozzle means is arranged to selectively reverse the direction of flow of the fluid.

15. A device as claimed in claim 11, wherein the nozzle means further is arranged to supply a cold fluid in a direction towards the overlapping portions of the sleeve.

16. A device as claimed in claim 11, wherein the nozzle means is yieldably loaded in a direction towards the side of the compressed stack.

17. A device as claimed in claim 11, wherein the suction means comprises a double-walled metal sheet extending in the feeding direction along a part of the compressed stack, the metal sheet being formed with apertures and being connected to a source of negative pressure.

18. A device as claimed in claim 11, wherein the sealing arrangement further comprises means for sealing and cutting the sleeve transversely of the feeding direction.

19. A device as claimed in claim 10, wherein the nozzle means further is arranged to supply a cold fluid in a direction towards the overlapping portions of the sleeve.

20. A device as claimed in claim 10, wherein the nozzle means is yieldably loaded in a direction towards the side of the compressed stack.

21. A device as claimed in claim 20, wherein the nozzle means is arranged in a pendulum construction to be pivotable towards and away from the side of the compressed stack.

22. A device as claimed in claim 10, wherein the suction means comprises a double-walled metal sheet extending in the feeding direction along a part of the compressed stack the metal sheet being formed with apertures and being connected to a source of negative pressure.

23. A device as claimed in claim 10, wherein the sealing arrangement further comprises means for sealing and cutting the sleeve transversely of the feeding direction.

24. A device as claimed in claim 23, wherein the means for sealing and cutting the sleeve transversely of the feeding direction is positioned downstream of the suction means.

* * * * *